US007603784B2

(12) United States Patent
Erhard

(10) Patent No.: US 7,603,784 B2
(45) Date of Patent: Oct. 20, 2009

(54) ROTATING PIN SIGHT

(76) Inventor: Rory J. Erhard, P.O. Box 1124, Belgrade, MT (US) 59714

( * ) Notice: Subject to any disclaimer, the term of this patent is extended or adjusted under 35 U.S.C. 154(b) by 44 days.

(21) Appl. No.: 12/075,855

(22) Filed: Mar. 13, 2008

(65) Prior Publication Data

US 2008/0222904 A1 Sep. 18, 2008

Related U.S. Application Data

(60) Provisional application No. 60/918,641, filed on Mar. 14, 2007.

(51) Int. Cl.
*F41G 1/467* (2006.01)

(52) U.S. Cl. ..... 33/265; 124/87

(58) Field of Classification Search ..... 33/265; 124/87, 88

See application file for complete search history.

(56) References Cited

U.S. PATENT DOCUMENTS

| | | | | | |
|---|---|---|---|---|---|
| 2,925,656 | A * | 2/1960 | Genovise | 33/265 |
| 3,521,362 | A * | 7/1970 | Duplechin | 33/265 |
| 3,997,974 | A * | 12/1976 | Larson | 33/265 |
| 4,457,076 | A | 7/1984 | Heck | |
| 4,497,116 | A | 2/1985 | Hawkins | |
| 4,616,623 | A * | 10/1986 | Williams | 124/87 |
| 5,063,678 | A | 11/1991 | Simo | |
| 5,127,166 | A * | 7/1992 | Bishop | 33/265 |
| 5,303,479 | A | 4/1994 | Rudovsky | |
| 5,305,530 | A | 4/1994 | Robertson, Jr. et al. | |
| 6,082,012 | A | 7/2000 | McLeod | |
| 6,145,208 | A * | 11/2000 | Savage | 33/265 |
| 6,418,633 | B1 | 7/2002 | Rager | |
| 6,477,780 | B2 | 11/2002 | Aldred | |
| 6,560,884 | B1 | 5/2003 | Afshari | |
| 6,601,308 | B2 * | 8/2003 | Khoshnood | 33/265 |
| 6,634,110 | B2 | 10/2003 | Johnson | |
| 6,938,349 | B2 | 9/2005 | Afshari | |
| 7,328,515 | B2 | 2/2008 | Helm et al. | |
| 7,503,122 | B2 * | 3/2009 | Afshari | 33/265 |
| 2006/0283028 | A1 * | 12/2006 | Afshari | 33/265 |
| 2008/0282560 | A1 * | 11/2008 | Bradley et al. | 33/265 |
| 2009/0000134 | A1 * | 1/2009 | Kurtzhals et al. | 33/265 |

* cited by examiner

*Primary Examiner*—G. Bradley Bennett
(74) *Attorney, Agent, or Firm*—Robert M. Hunter

(57) ABSTRACT

A bow sight comprising: a main body having a plurality of grooves; a first support structure having a first ring clamp that is linearly slidably mounted in one of said grooves; a first sight ring that is rotatably coupled to said first support structure; a first sight pin that is fixedly mounted on said first sight ring; a second support structure having a second ring clamp that is linearly slidably mounted in another of said grooves; a second sight ring that is rotatably coupled to said second support structure; and a second sight pin that is fixedly mounted on said second sight ring.

20 Claims, 14 Drawing Sheets

ROTATING PIN SIGHT

CROSS-REFERENCE TO RELATED APPLICATIONS

This application claims the benefit of U.S. Provisional Patent Application No. 60/918,641, filed Mar. 14, 2007, the disclosure of which patent application is incorporated by reference as if fully set forth herein.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

This invention relates to an archery sight that is mounted on a bow. In particular, the invention relates to a linearly adjustable and rotatably adjustable pin sight.

Background art archery sights or aiming devices have a plurality of sight pins that are mounted in a single permanent position. Typically, the sight pins are in a horizontal or vertical plane.

The background art is characterized by U.S. Pat. Nos. 4,457,076; 4,497,116; 5,063,678; 5,303,479; 5,305,530; 6,082,012; 6,418,633; 6,477,780; 6,560,884; 6,634,110; 6,938,349; and 7,328,515; the disclosures of which patents are incorporated by reference as if fully set forth herein.

U.S. Pat. No. 6,938,349 discloses and claims a bow sight comprising: a first mounting structure; a first pin guard coupled to said first mounting structure and vertically (linearly) adjustable relative thereto; a second pin guard coupled to said first mounting structure and vertically (linearly) adjustable relative to said first mounting structure and independently vertically (linearly) adjustable relative to said first pin guard; a first sight pin fixedly mounted relative to said first pin guard; and a second sight pin fixedly mounted relative to said second pin guard; whereby said first pin guard is positioned in front of said second pin guard when viewed in an aiming orientation.

BRIEF SUMMARY OF THE INVENTION

The purpose of the invention is to provide a linearly and rotationally adjustable archery sight. One advantage of the invention is that each sight ring may be independently rotated and independently linearly moved relative to the main body of the sight.

In a preferred embodiment, the invention is an archery sight that comprises a plurality of sight pins that allow the user to infinitely adjust the rotational orientation of each sight pin at any angle. This is preferably accomplished by having the aiming point of each sight pin substantially centered in a round self-contained site ring or first member that is secured by a support structure or second member to the main body of the sight. The second member is preferably rotatable within the second member to enable the user to adjust the sight pins at any desired angle relative to the main body of the sight. The second member is also preferably slidably adjustable upward and downward relative to the main body giving each sight pin a vertical or horizontal adjustment capability.

In a preferred embodiment, each sight ring is temporarily fixed at a selected angular orientation within each support structure by a sight ring clamp. When the sight ring clamp is loosened, the sight ring may be turned to orient the sight pin at any desired angle without changing the position of the sight pin in a vertical or horizontal plane.

In another preferred embodiment, each sight ring is independently adjustable vertically and rotationally relative to the other sight pins. Preferably, the user is able to remove unwanted sight rings, or to add more, if desired.

In another preferred embodiment, each sight ring comprises a scintillating (flashing) fiber optic cable that is wrapped in a groove around the sight ring and then threaded through a channel up to the perfectly centered aiming point of the sight pin.

In a preferred embodiment, the invention is a bow sight comprising: a main body having a plurality of grooves or a plurality of tongues; a first support structure having a first ring clamp that is linearly slidably mounted in at least one of said grooves or on at least one of said tongues; a first sight ring that is rotatably coupled to said first support structure; a first sight pin that is fixedly mounted on said first sight ring; a second support structure having a second ring clamp that is linearly slidably mounted in another at least one of said grooves or on another of at least one of said tongues; a second sight ring that is rotatably coupled to said second support structure; and a second sight pin that is fixedly mounted on said second sight ring. Preferably, each support structure is linearly adjustable relative to said main body. Preferably, each sight ring is rotationally adjustable relative to the associated support structure. Preferably, each sight ring is detachable from said main body. Preferably, each sight ring and sight pin combination support a fiber optic cable that terminates at an aiming point located at the end of said sight pin.

In another preferred embodiment, the invention is a sight for a bow, said sight comprising: a mounting bracket that is fixedly mounted on the bow; an adjustment bracket that is slidably mounted on said mounting bracket; a main body that is slidably mounted on said adjustment bracket; a first support structure having a first ring clamp that is slidably mounted on said main body; a first sight ring that is rotatably coupled to said first support structure; a first sight pin that is fixedly mounted on said first sight ring; a second support structure having a second ring clamp that is slidably mounted on said main body; a second sight ring that is rotatably coupled to said second support structure; and a second sight pin that is fixedly mounted on said second sight ring. Preferably, said adjustment bracket is horizontally and linearly slidably mounted on said mounting bracket. Preferably, said main body is vertically and linearly slidably mounted on said adjustment bracket. Preferably, said first support structure and said second support structure are vertically and linearly mounted on said main body. Preferably, each support structure is detachable from said main body. Preferably, each sight ring and sight pin combination support a fiber optic cable that terminates at an aiming point located at the end of said sight pin. Preferably, the sight further comprises: a third support structure having a third ring clamp that is slidably mounted on said main body; a third sight ring that is rotatably coupled to said third support structure; and a third sight pin that is fixedly mounted on said third sight ring.

In yet another preferred embodiment, the invention is a sight for a bow, said sight comprising: a main body that is mounted on the bow; a first support structure that is slidably mounted on said main body; a first sight ring that is rotatably coupled to said first support structure; a first sight pin that is fixedly mounted on said first sight ring; a second support structure that is slidably mounted on said main body; a second sight ring that is rotatably coupled to said second support structure; and a second sight pin that is fixedly mounted on said second sight ring. Preferably, said first support structure and said second support structure are vertically and linearly mounted on said main body. Preferably, each support structure is detachable from said main body. Preferably, each sight ring and sight pin combination support a fiber optic cable that terminates at an aiming point located at the end of said sight pin.

In yet another preferred embodiment, the invention is a sight for a bow comprising: a plurality of sight pins that are independently rotatably adjustably coupled and linearly adjustably coupled to a main body that is attached to the bow, each of said sight pins having an aiming point. Preferably, each of said sight pins has substantially the same length. Preferably, each of said sight pins is mounted in a support structure that comprises a ring clamp that is bolted to said main body. Preferably, each of said sight pins is mounted in a support structure that comprises a ring clamp that comprises a radial tab that is clamped within said main body.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
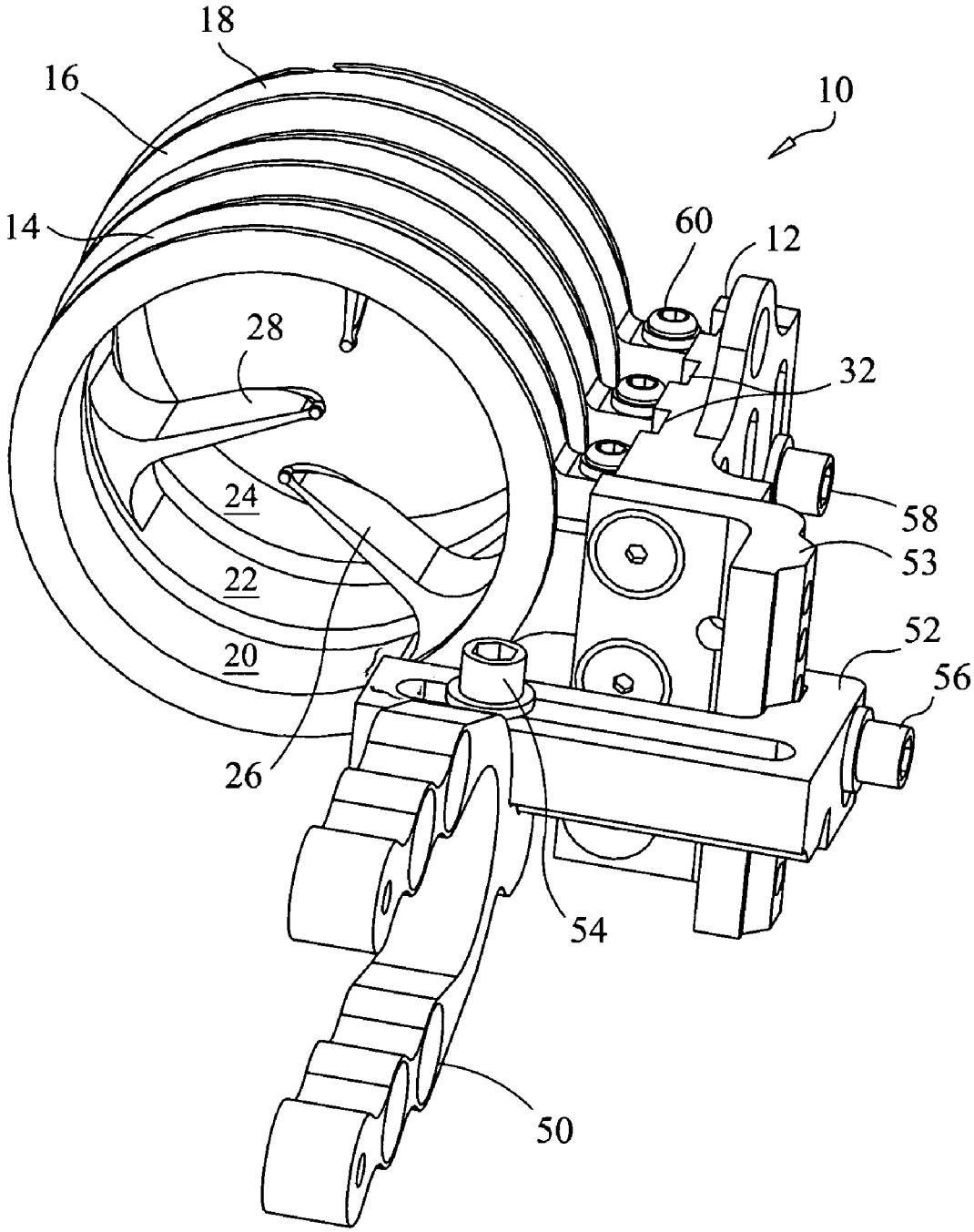
FIG. 1 is a perspective view of a preferred embodiment of the invention.

following reference numerals are used to indicate the parts and environment of the invention on the drawings:

10 bow sight, pin sight, rotatable pin sight
12 main body
14 first support structure
16 second support structure
18 third support structure
20 first sight ring
22 second sight ring
24 third sight ring
26 first sight pin
28 second sight pin
30 third sight pin
32 grooves
34 first ring clamp
36 second ring clamp
38 third ring clamp
40 fiber optic cable
42 aiming reference point, aiming point
44 fiber optic wrap channel
46 fiber optic channel
50 bow mounting bracket, mounting bracket
52 adjustment bracket
53 main body bracket
54 adjustment bolt
56 body bolt
58 support bolts
60 clamp bolts
64 first radial tab
66 second radial tab
68 third radial tab
70 tongues
72 grooves
74 first spacer block
76 second spacer block
78 third spacer block
80 through bolts
82 main body base, base

DETAILED DESCRIPTION OF THE INVENTION

Figure 2:
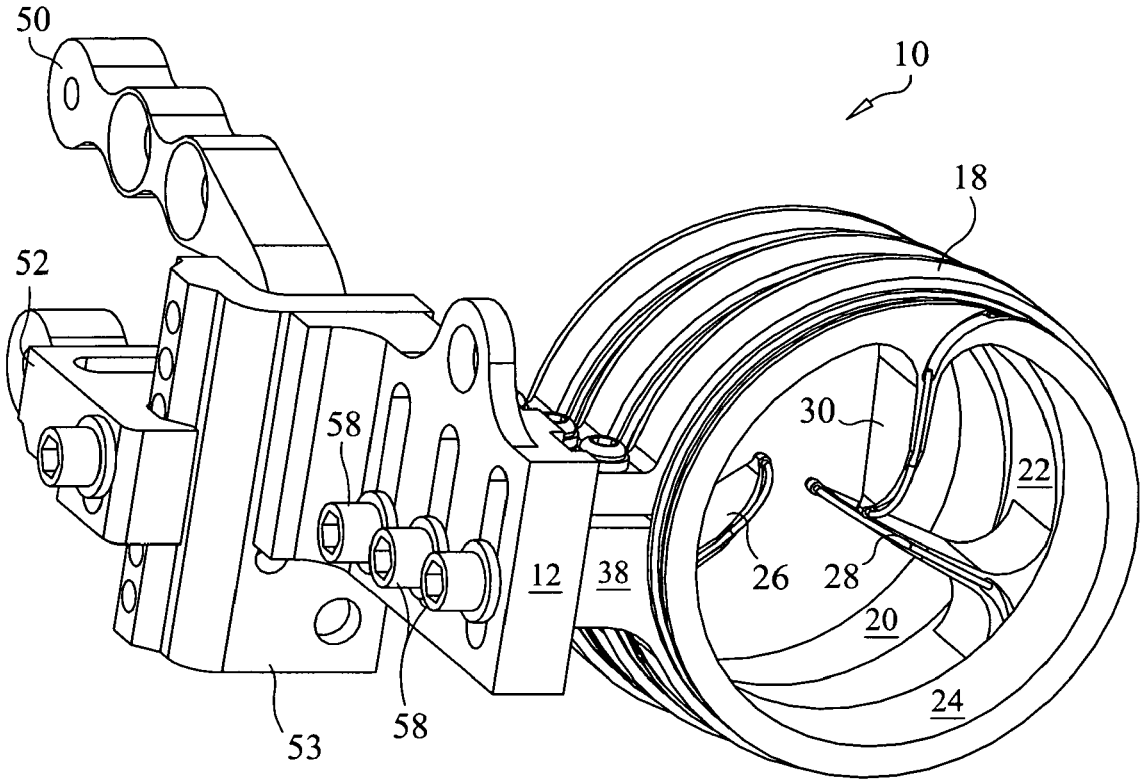
FIG. 2 is another perspective view of the preferred embodiment of the invention of FIG. 1.

Referring to FIGS. 1 and 2, a preferred embodiment of bow sight 10 is presented. In this embodiment, bow sight 10 comprises: main body 12, first support structure 14, second support structure 16, third support structure 18, first sight ring 20, second sight ring 22, third sight ring 24, first sight pin 26, second sight pin 28 and third sight pin 30. Main body 12 preferably has a plurality of grooves 32 and is preferably attached to bow mounting bracket 50 by means of body bracket 53 which is preferably attached to or a part of adjustment bracket 52. Bow sight 10 is preferably attached to a bow (not shown) by bow mounting bracket 50. A person having ordinary skill in the art would understand that main body 12 may be attached to the bow in other ways, e.g., directly or by means of another conventional or unanticipated mechanism. A person having ordinary skill in the art would also understand that one or a plurality of support structure/sight ring combinations may be incorporated into bow sight 10.

First support structure 14 preferably comprises first ring clamp 34 that is linearly slidably mounted in one of said grooves 32. First sight ring 20 is preferably rotatably coupled to first support structure 14 and first sight pin 26 is preferably fixedly mounted on (e.g., attached to or part of) first sight ring 20. Rotation of first sight ring 20 relative to first support structure 14 may be prevented by tightening first ring clamp 34.

Second support structure 16 similarly has second ring clamp 36 that is preferably linearly slidably mounted in another of said grooves 32. Second sight ring 22 is preferably rotatably coupled to second support structure 16, and second sight pin 28 is preferably fixedly mounted on second sight ring 22. Rotation of second sight ring 22 relative to second support structure 16 may be prevented by tightening second ring clamp 36.

Third support structure 18 similarly has third ring clamp 38 that is preferably linearly slidably mounted in another of said grooves 32. Third sight ring 24 is preferably rotatably coupled to third support structure 18 and third sight pin 30 is preferably fixedly mounted on third sight ring 24. Rotation of third sight ring 24 relative to third support structure 18 may be prevented by tightening third ring clamp 38.

Preferably, each support structure 14, 16 and 18 is linearly adjustable relative to main body 12 by first loosening the appropriate one of support bolts 58, moving the support structure relative to main body 12 and then tightening the appropriate one of support bolts 58. Preferably, each sight ring 20, 22 and 24 is rotationally adjustable relative to the associated support structure 14, 16 and 18 by adjusting the ring clamps as noted above. Preferably, each sight ring 20, 22 and 24 and each support structure 14, 16 and 18 are detachable from main body 12 by removing the appropriate one of the support bolts 58 as noted above.

Figure 3:
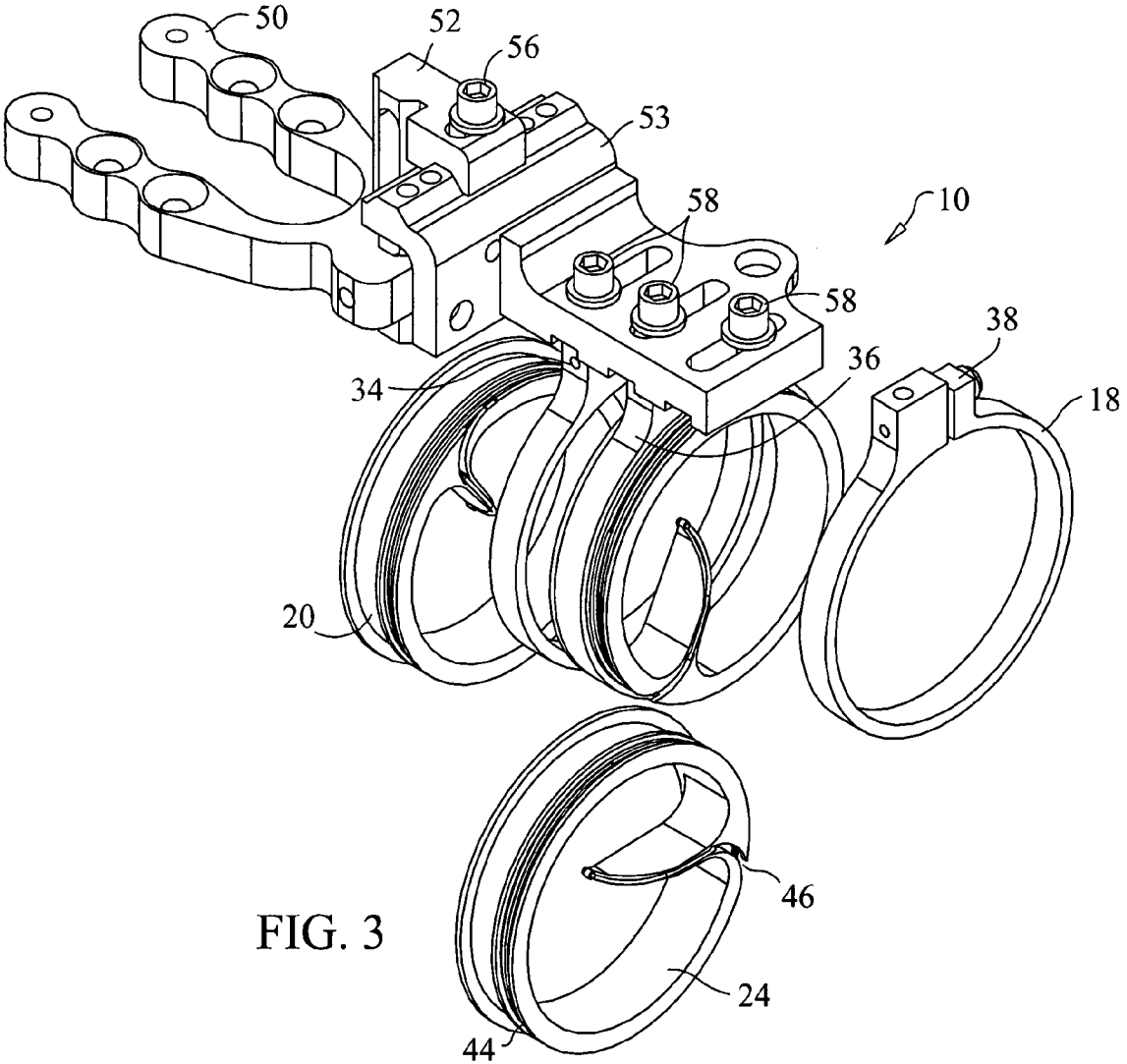
FIG. 3 is an exploded perspective view of the preferred embodiment of the invention of FIG. 1.
Figure 4:
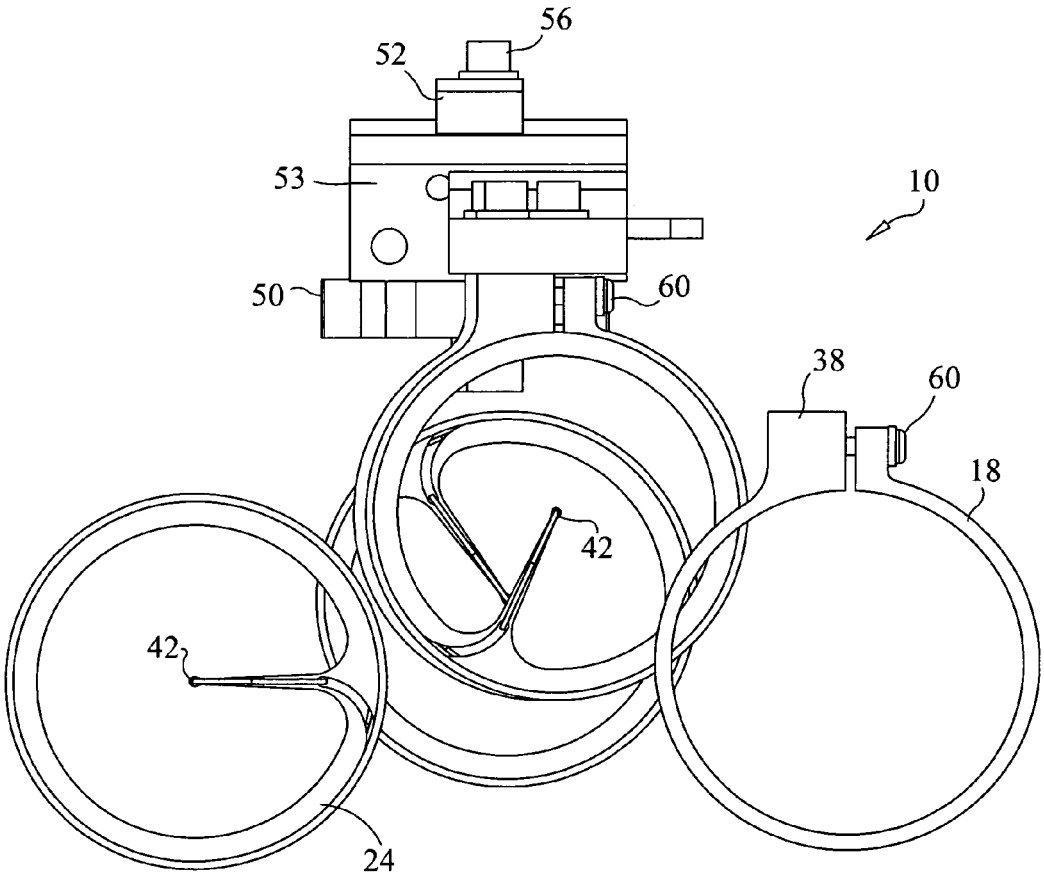
FIG. 4 is an exploded elevation (front) view of the preferred embodiment of the invention of FIG. 1.

Referring to FIGS. 3 and 4, exploded views of a preferred embodiment of partially disassembled bow sight 10 are presented. Support structure 18 is shown detached from main body 12 with ring clamp clearly visible. In use, the two parts of ring clamp 38 are squeezed by tightening an appropriate one of the clamp bolts 60, thereby clamping sight ring 24 in position within support structure 18.

Figure 5:
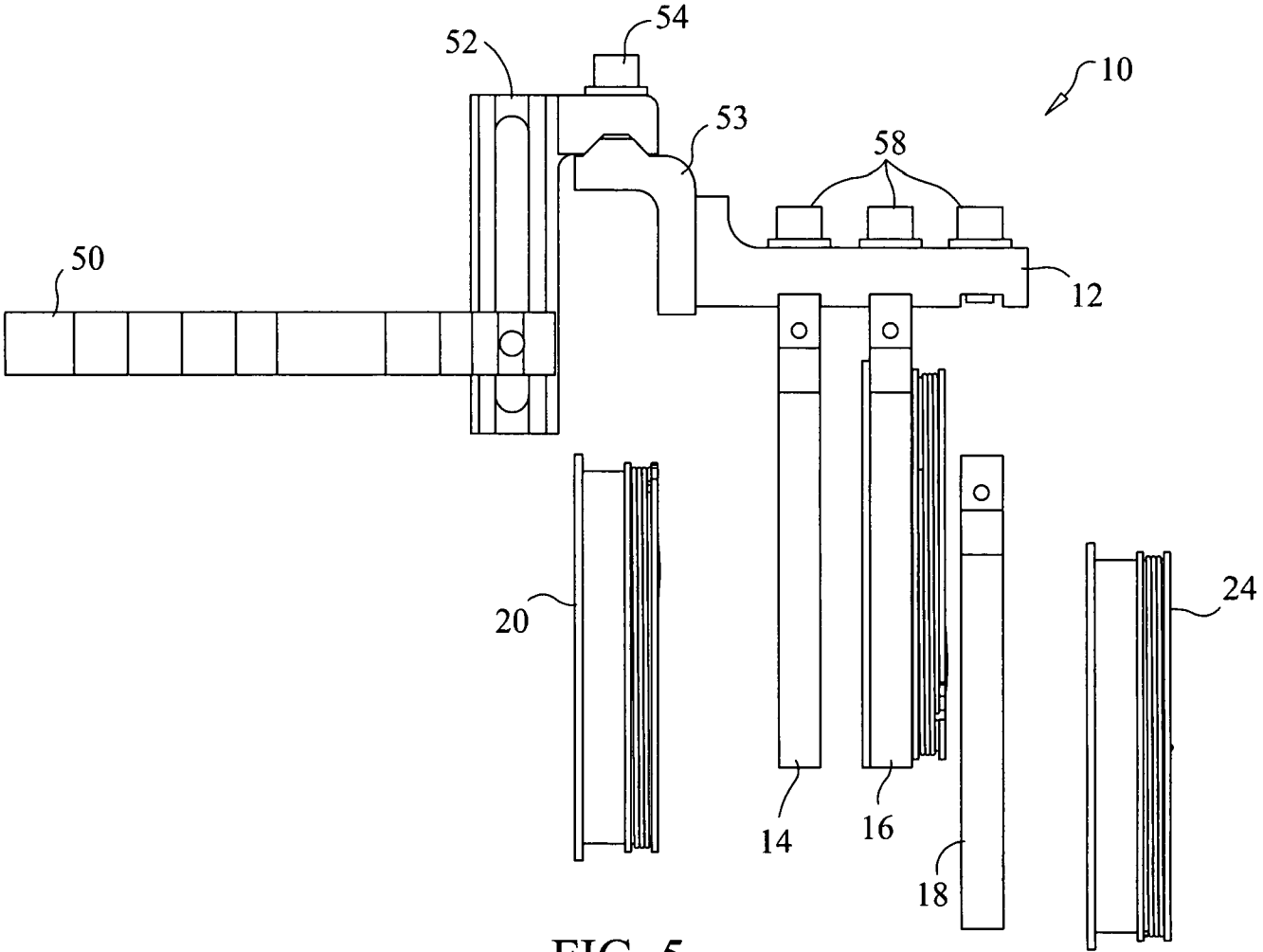
FIG. 5 is an exploded plan (top) view of the preferred embodiment of the invention of FIG. 1.
Figure 6:
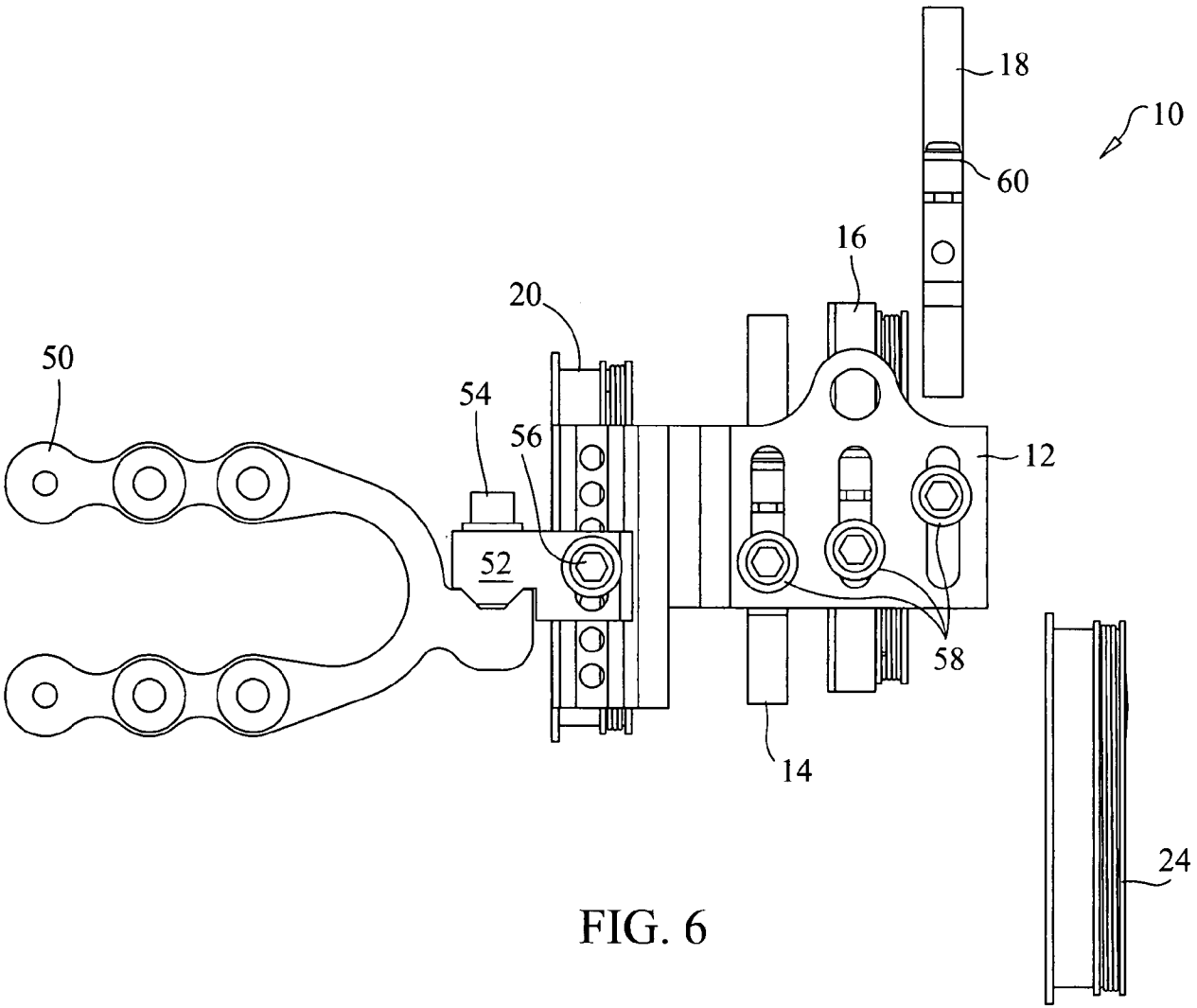
FIG. 6 is an exploded elevation (side) view of the preferred embodiment of the invention of FIG. 1.
Figure 7:
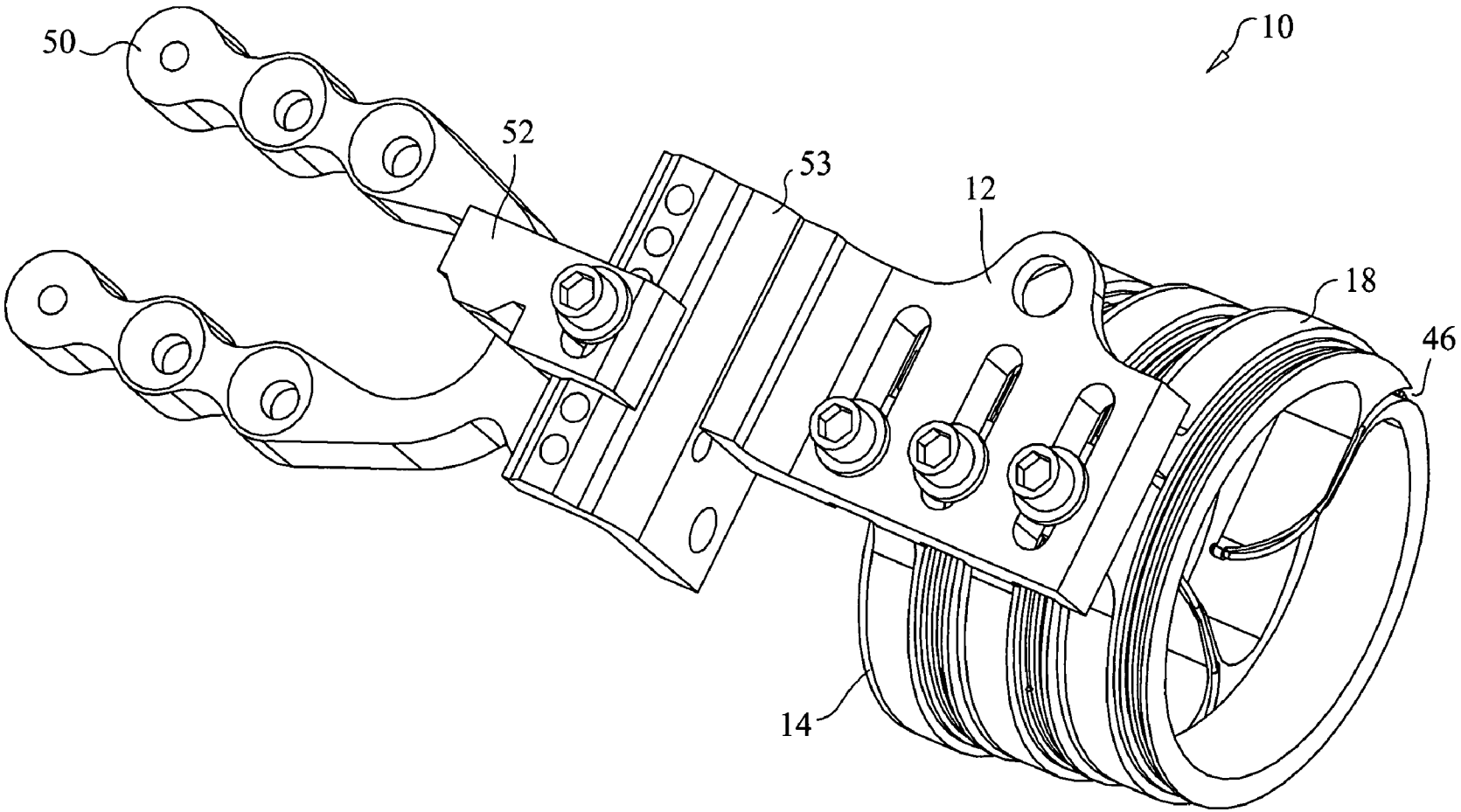
FIG. 7 is another perspective view of the preferred embodiment of the invention of FIG. 1.
Figure 8:
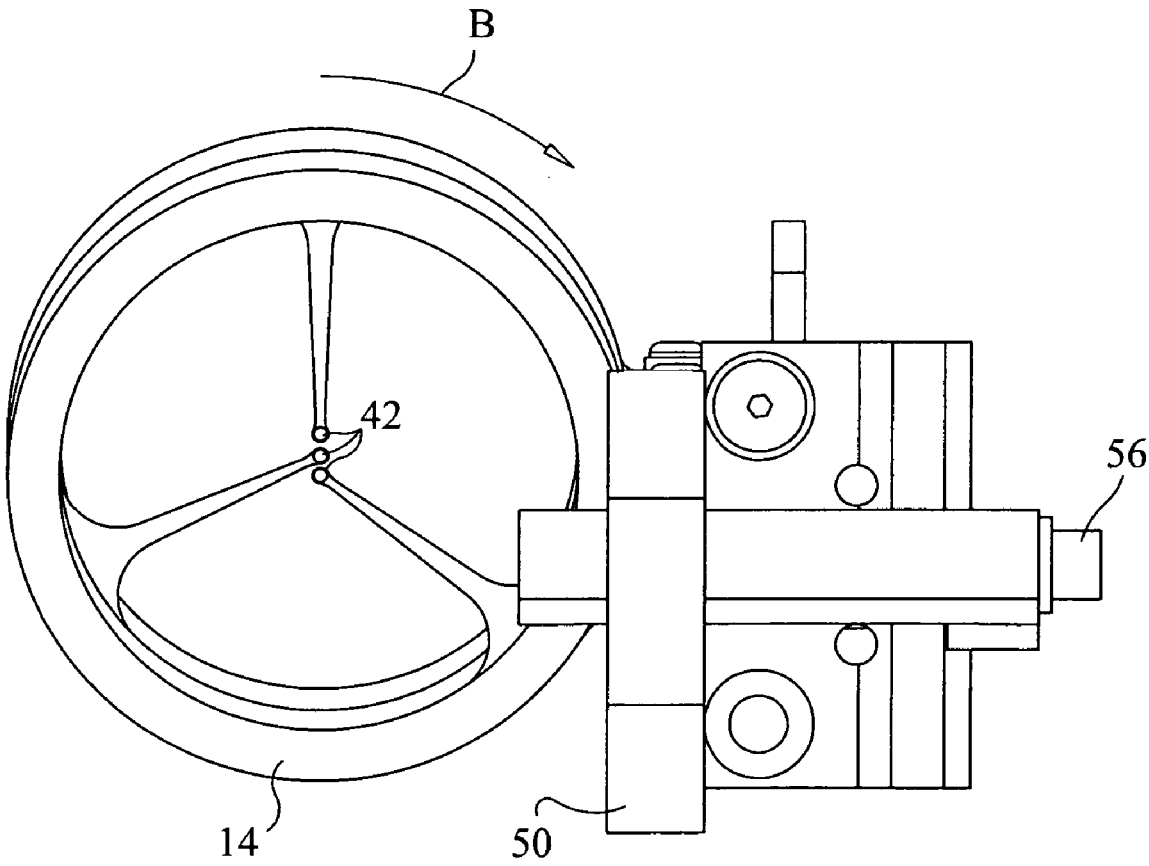
FIG. 8 is an elevation (front) view of the preferred embodiment of the invention of FIG. 1.
Figure 9:
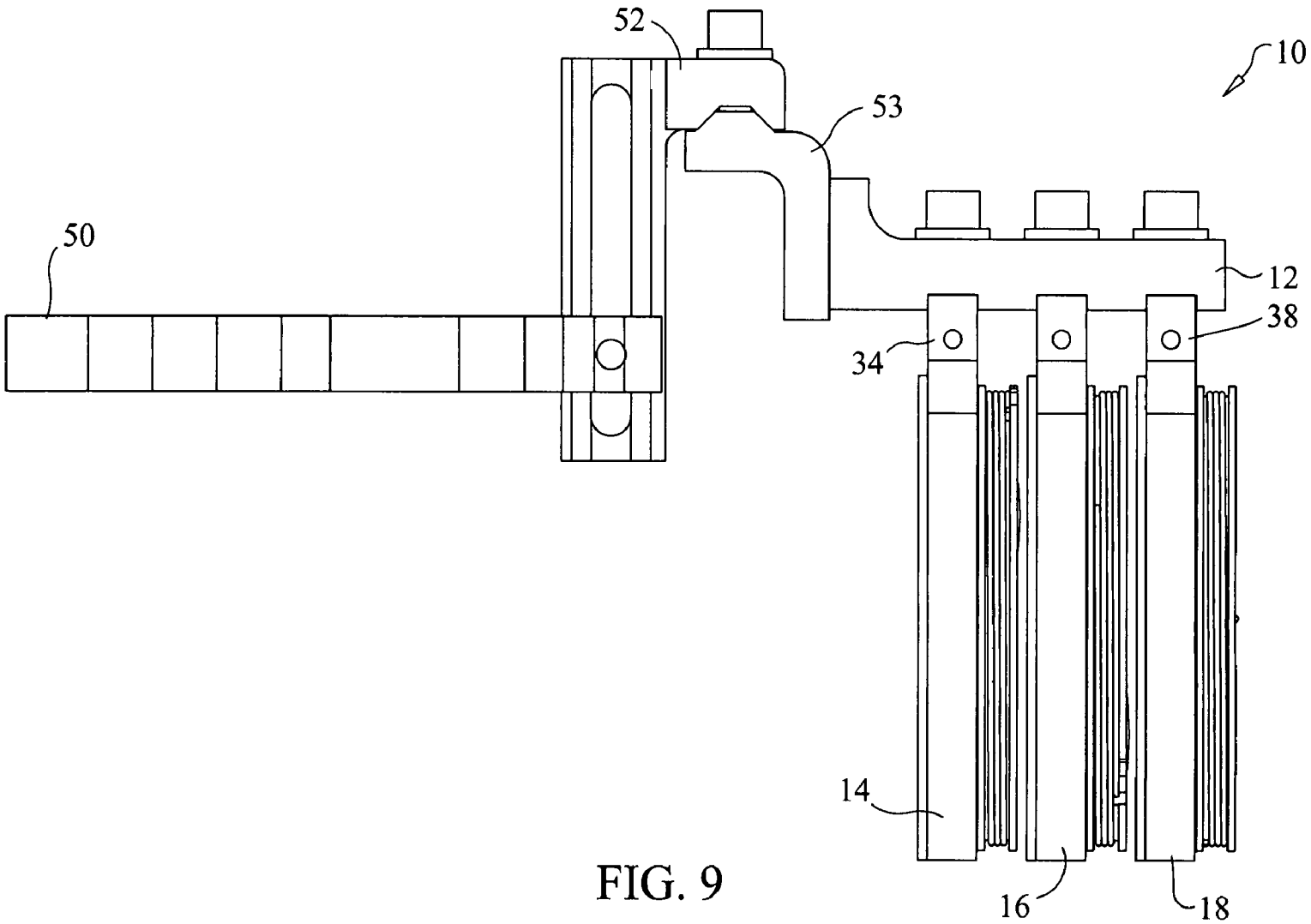
FIG. 9 is a plan (top) view of the preferred embodiment of the invention of FIG. 1.
Figure 10:
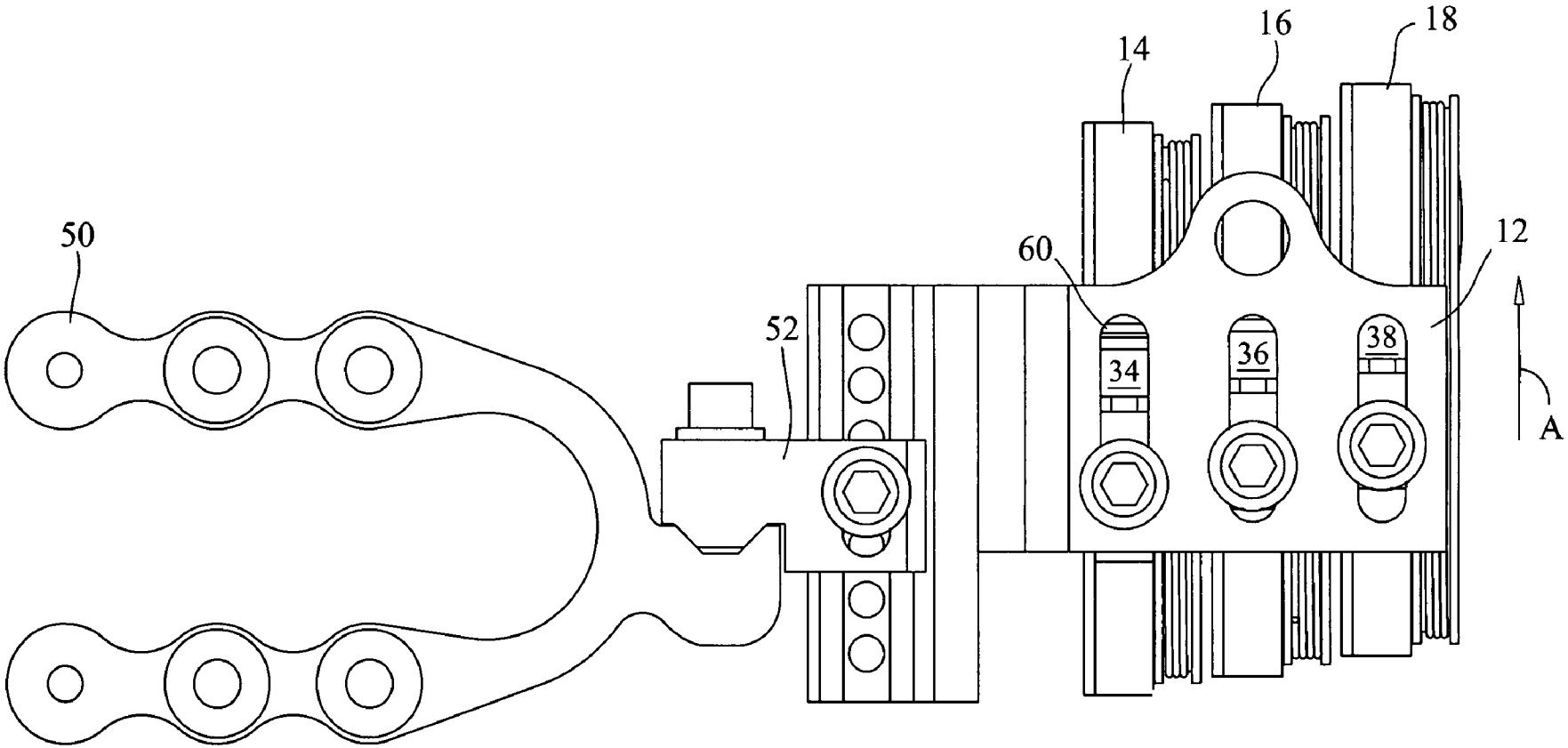
FIG. 10 is an elevation (side) view of the preferred embodiment of the invention of FIG. 1.

Referring to FIGS. 5 and 6, exploded views of a preferred embodiment of partially disassembled bow sight 10 are presented. In these views, sight rings 20 and 24 are shown detached from support structures 14 and 18, respectively. In FIG. 5, main body bracket 53, which may be integral to main body 12, is shown connecting main body 12 to adjustment bracket 52. In FIG. 6, support bolts 58 are shown at different positions in grooves 32.

Referring to FIGS. 7-10, adjustments to a preferred embodiment of bow sight 10 are illustrated. Adjustment bracket 52 may be adjusted from side to side relative to bow mounting bracket 50 and is held in position by tightening adjustment bolt 54. Main body 12 may be adjusted up and down relative to adjustment bracket 52 and is held in position by tightening body bolt 56. Support structures 14, 16 and 18 are shown individually offset from one another vertically in direction A, with support structure 14 being in the lowest position and support structure 18 being in the highest position. Support structures 14, 16 and 18 are held in position by tightening support bolts 58. Rotation of sight rings 20, 22 and 24 relative to one another in angular direction B (or in the opposite direction) results in the orientation shown in FIG. 8. Sight rings 20, 22 and 24 are held in angular position by clamp bolts 60.

Figure 11:
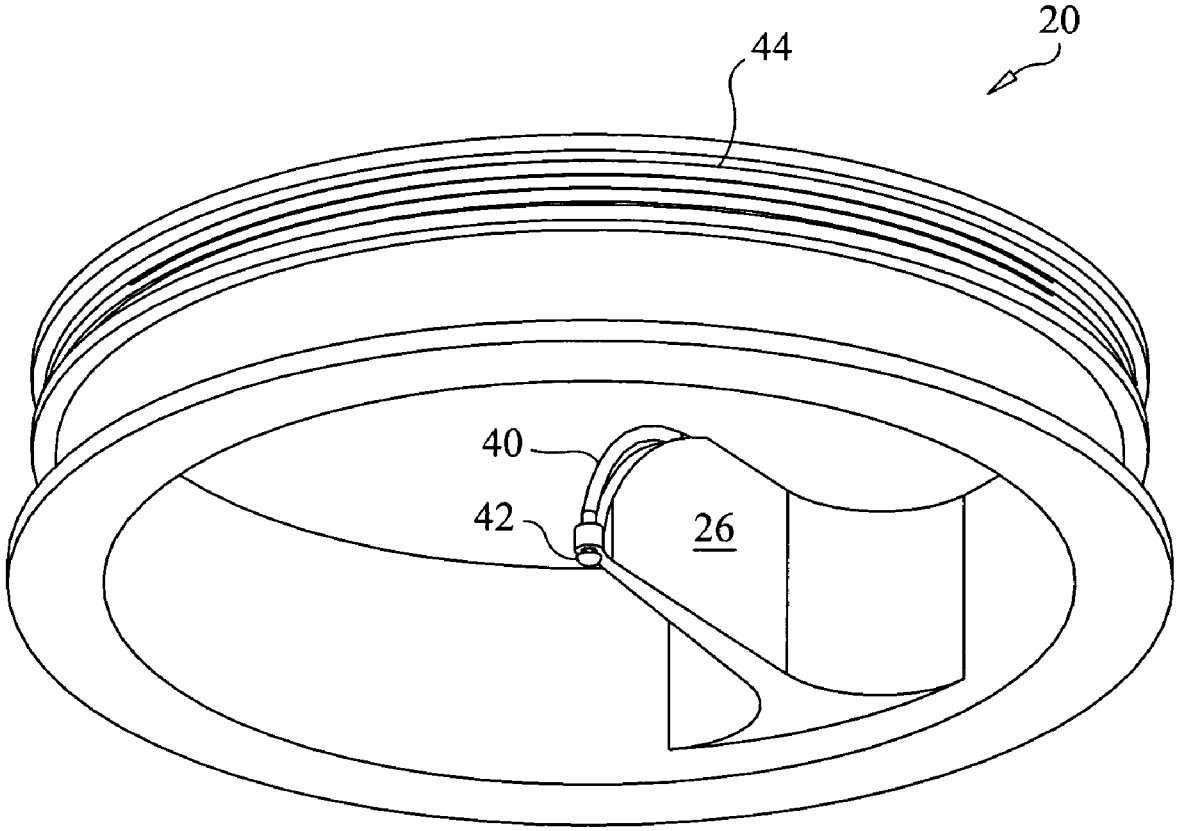
FIG. 11 is a perspective view of a sight ring of a preferred embodiment of the invention.

Referring to FIG. 11, a preferred embodiment of an example sight ring 20 is presented. In this embodiment, each sight ring (20, 22 and 24) and sight pin (26, 28 and 30) combination support fiber optic cable 40 that terminates at aiming point 42 located at the end of each sight pin. Each fiber optic cable 40 is disposed in fiber optic wrap channel 44 in each sight ring and in fiber optic channel 46 in each sight pin. Each fiber optic cable 40 gathers light from ambient sunlight or from a manmade light producing device. The light is transmitted to each aiming point 42 located at the end of each fiber optic cable 40. Each aiming point 42 is used by the archer as a reference point for aiming at targets located at different distances.

Figure 12:
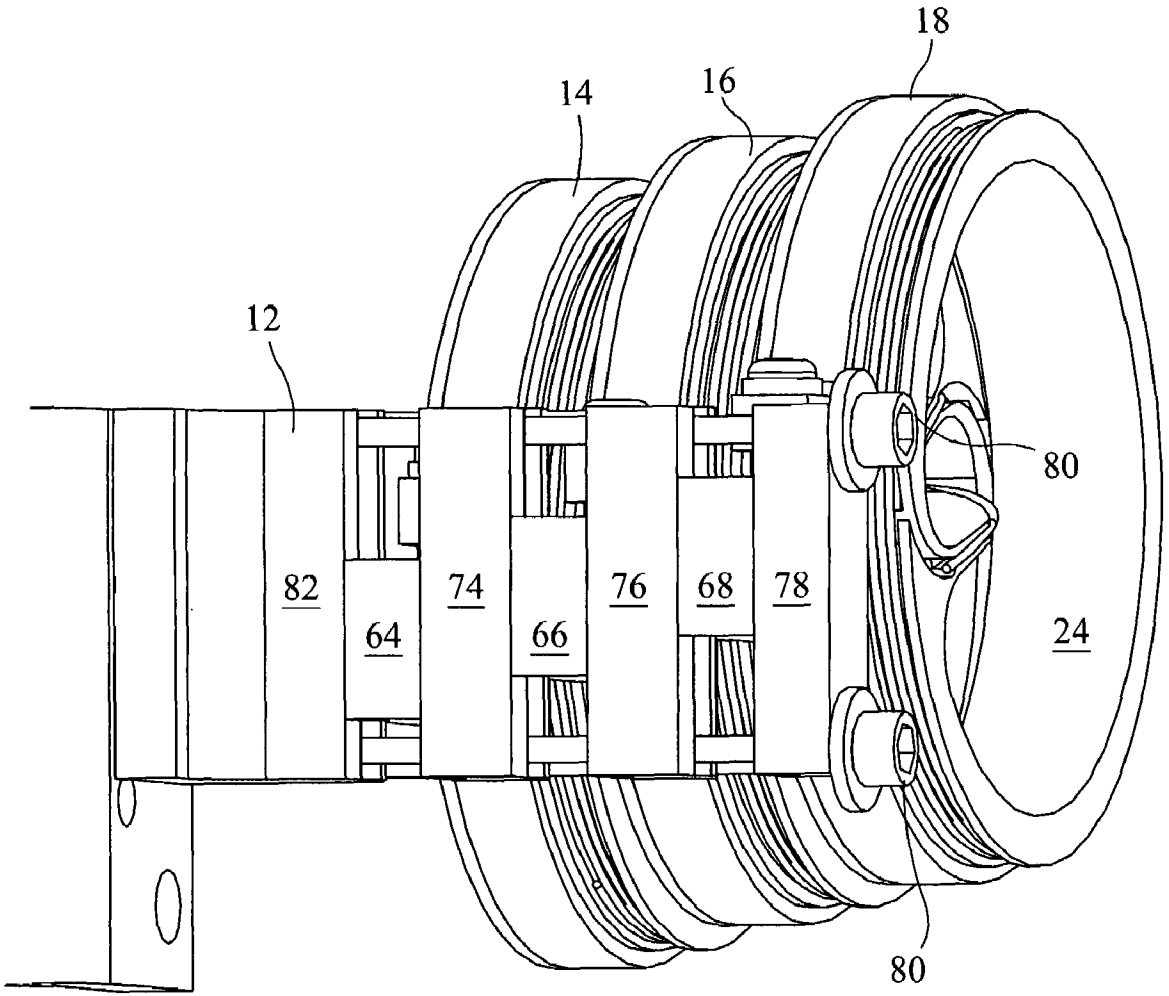
FIG. 12 is a perspective view of an alternative embodiment of the invention.
Figure 13:
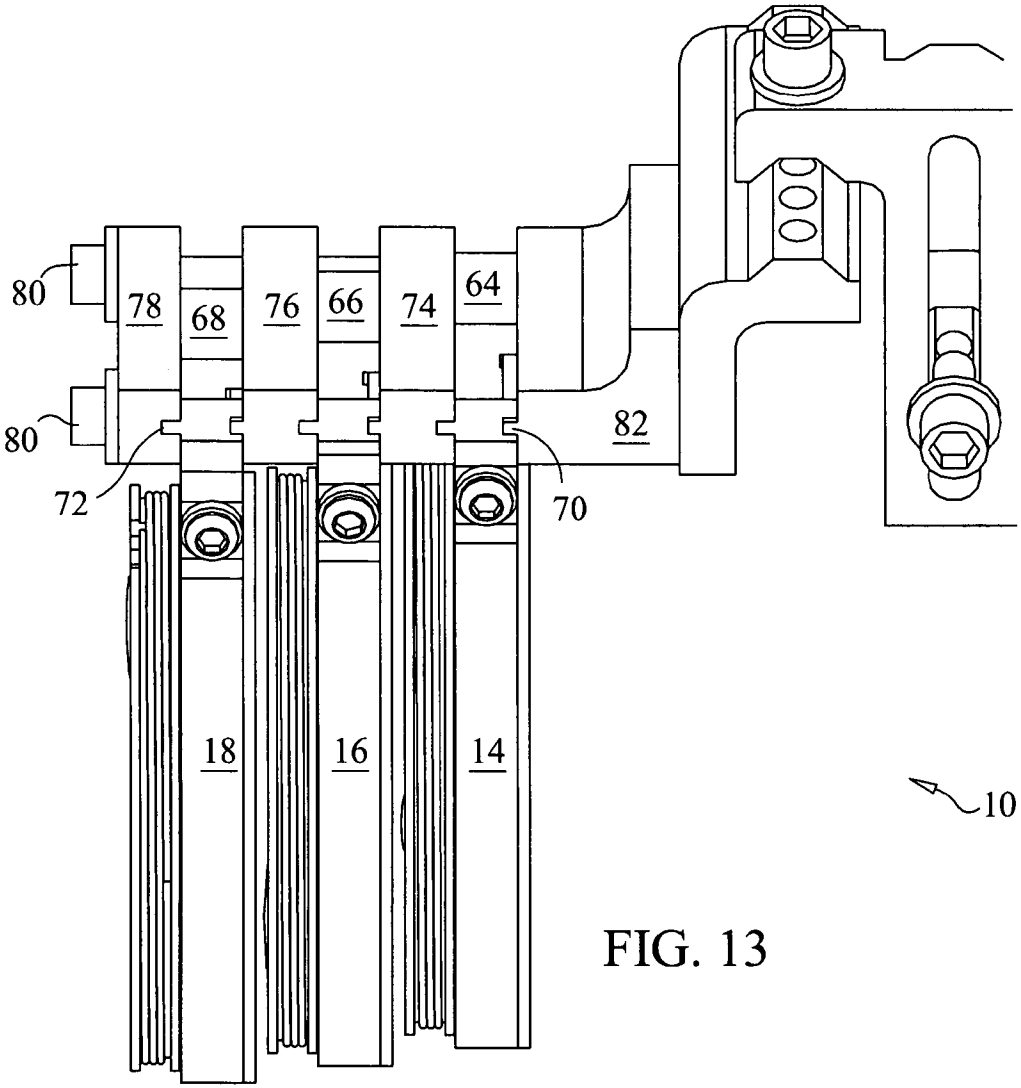
FIG. 13 is another perspective view of an alternative embodiment of FIG. 12.
Figure 14:
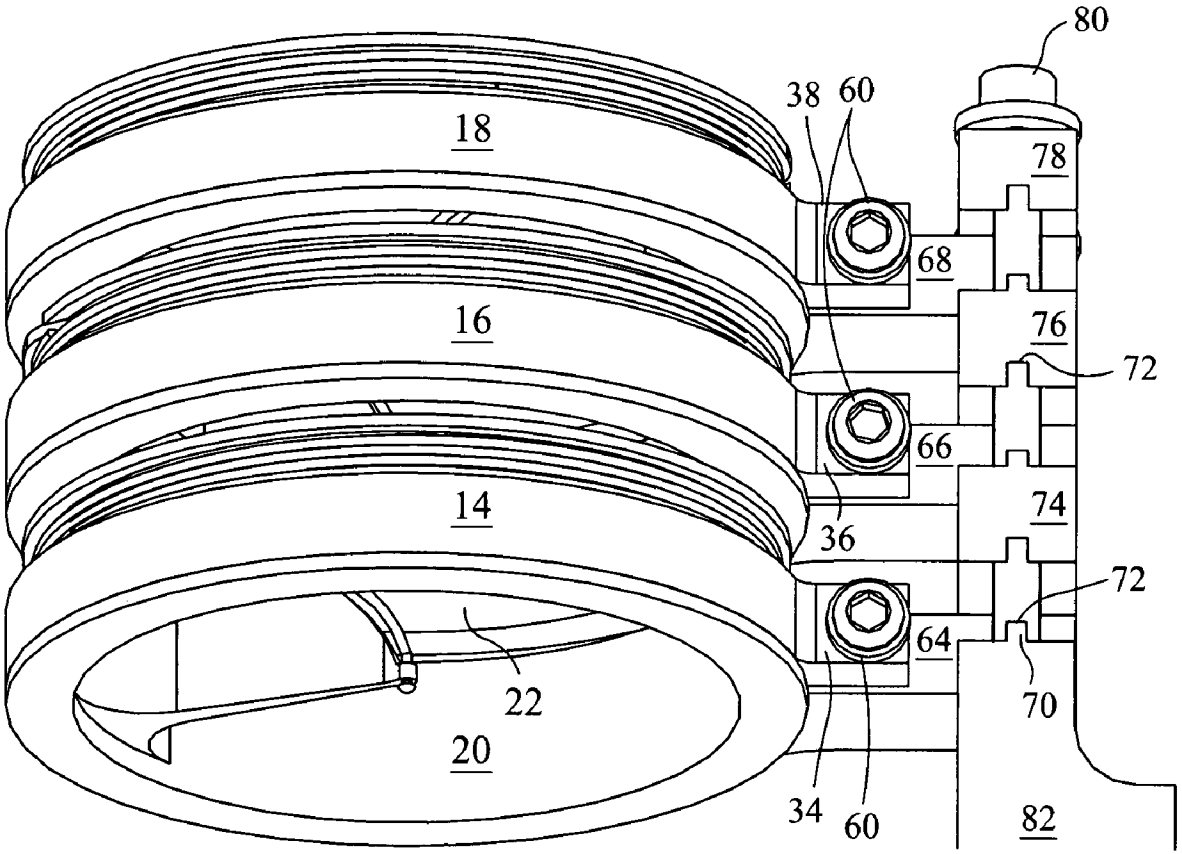
FIG. 14 is another perspective view of an alternative embodiment of FIG. 12.

Referring to FIG. 12-14, an alternative embodiment of the invention is presented. In this embodiment, an alternative mechanism is used to attach support structures 14, 16 and 18 to main body 12. Each of the ring clamps 34, 36 and 38 of the support structures 14, 16 and 18 are provided with radial tabs 64, 66 and 68 that have tongues 70 that fit in grooves 72 in spacer blocks 74, 76 and 78 that, in this embodiment, form part of main body 12. Similarly, base 82 and each of the spacer blocks 74, 76 have tongues 70 that fit into grooves 72 in radial tabs 64, 66 and 68. Through bolts 80 pass through holes in the spacer blocks and radial tabs, and screw into threaded holes in base 82 of main body 12, thereby clamping the support structures into position. When the through bolts 80 are loosened, tongues 70 slide in grooves 72, allowing the support structures 14, 16 and 18 to be positioned. Support structures (and/or associated sight rings and sight pins) may be added or removed from pin sight 10 by sufficiently loosening or removing through bolts 80. Thus, the archer may clamp one or many support structures to main body 12. A person having ordinary skill in the art would understand that adjacent parts could have grooves instead of tongues, provided that the mating part was so modified. For example, each of the radial tabs could have two tongues or two grooves, with the mating parts provided with grooves or tongues.

Operation of the invention involves adjusting each sight ring 20, 22 and 24 in a vertical manner so that each aiming reference point 42 appears over the precise point on the target that the arrow is intended to strike at a given distance. Sight rings 20, 22 and 24 may be oriented in selected rotational orientations in accordance with the preference of the user.

Many variations of the invention will occur to those skilled in the art. Some variations include two or more supporting brackets. Other variations call for fiber optic augmentation of the visibility of the aiming point. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. A bow sight comprising:

a main body having a plurality of grooves or a plurality of tongues;

a first support structure having a first ring clamp that is linearly slidably mounted in at least one of said grooves or on at least one of said tongues;

a first sight ring that is rotatably coupled to said first support structure;

a first sight pin that is fixedly mounted on said first sight ring;

a second support structure having a second ring clamp that is linearly slidably mounted in another of at least one of said grooves or on another at least one of said tongues;

a second sight ring that is rotatably coupled to said second support structure; and a second sight pin that is fixedly mounted on said second sight ring.

2. The bow sight of claim 1 wherein each support structure is linearly adjustable relative to said main body.

3. The bow sight of claim 1 wherein each sight ring is rotationally adjustable relative to the associated support structure.

4. The bow sight of claim 1 wherein each sight ring is detachable from said main body.

5. The bow sight of claim 1 wherein each sight ring and sight pin combination support a fiber optic cable that terminates at an aiming point located at the end of said sight pin.

6. A sight for a bow, said sight comprising:

a mounting bracket that is fixedly mounted on the bow;

an adjustment bracket that is slidably mounted on said mounting bracket;

a main body that is slidably mounted on said adjustment bracket;

a first support structure having a first ring clamp that is slidably mounted on said main body;

a first sight ring that is rotatably coupled to said first support structure;

a first sight pin that is fixedly mounted on said first sight ring;

a second support structure having a second ring clamp that is slidably mounted on said main body;

a second sight ring that is rotatably coupled to said second support structure; and a second sight pin that is fixedly mounted on said second sight ring.

7. The sight of claim 6 wherein said adjustment bracket is horizontally and linearly slidably mounted on said mounting bracket.

8. The sight of claim 6 wherein said main body is vertically and linearly slidably mounted on said adjustment bracket.

9. The sight of claim 6 wherein said first support structure and said second support structure are vertically and linearly mounted on said main body.

10. The sight of claim 6 wherein each support structure is detachable from said main body.

11. The sight of claim 6 wherein each sight ring and sight pin combination support a fiber optic cable that terminates at an aiming point located at the end of said sight pin.

12. The sight of claim 6 further comprising:

a third support structure having a third ring clamp that is slidably mounted on said main body;

a third sight ring that is rotatably coupled to said third support structure; and a third sight pin that is fixedly mounted on said third sight ring.

13. A sight for a bow, said sight comprising:

a main body that is mounted on the bow;

a first support structure that is slidably mounted on said main body;

a first sight ring that is rotatably coupled to said first support structure;

a first sight pin that is fixedly mounted on said first sight ring;

a second support structure that is slidably mounted on said main body;

a second sight ring that is rotatably coupled to said second support structure; and a second sight pin that is fixedly mounted on said second sight ring.

14. The sight of claim 13 wherein said first support structure and said second support structure are vertically and linearly mounted on said main body.

15. The sight of claim 13 wherein each support structure is detachable from said main body.

16. The sight of claim 13 wherein each sight ring and sight pin combination support a fiber optic cable that terminates at an aiming point located at the end of said sight pin.

17. A sight for a bow comprising:

a plurality of sight pins that are independently rotatably adjustably coupled and linearly adjustably coupled to a main body that is attached to the bow, each of said sight pins having an aiming point.

18. The sight of claim 17 wherein each of said sight pins has substantially the same length.

19. The sight of claim 17 wherein each of said sight pins is mounted in a support structure that comprises a ring clamp that is bolted to said main body.

20. The sight of claim 17 wherein each of said sight pins is mounted in a support structure that comprises a ring clamp that comprises a radial tab that is clamped within said main body.

* * * * *